US007536957B2

(12) United States Patent
Bush et al.

(10) Patent No.: US 7,536,957 B2
(45) Date of Patent: May 26, 2009

(54) FLOW THROUGH RAIL ROAD FREIGHT CAR

(75) Inventors: Keith Bush, Paris (CA); William Davis, Beamsville (CA)

(73) Assignee: National Steel Car Limited (CA)

( * ) Notice: Subject to any disclaimer, the term of this patent is extended or adjusted under 35 U.S.C. 154(b) by 370 days.

(21) Appl. No.: 11/158,328

(22) Filed: Jun. 22, 2005

(65) Prior Publication Data

US 2006/0288903 A1 Dec. 28, 2006

(51) Int. Cl.
*B61D 3/00* (2006.01)
*B61D 9/00* (2006.01)

(52) U.S. Cl. ..... 105/247; 105/280

(58) Field of Classification Search ..... 105/238.1, 105/247, 248, 249, 396, 404
See application file for complete search history.

(56) References Cited

U.S. PATENT DOCUMENTS 4,362,111 A * 12/1982 Stark et al. ..... 105/247
4,455,947 A * 6/1984 Reeve et al. ..... 105/377.01
4,598,646 A * 7/1986 Dugge et al. ..... 105/248
5,011,038 A * 4/1991 Schultz ..... 220/320
6,389,986 B1 * 5/2002 Twomey et al. ..... 105/359

* cited by examiner

*Primary Examiner*—S. Joseph Morano
*Assistant Examiner*—Robert J McCarry, Jr.
(74) *Attorney, Agent, or Firm*—Hahn Loeser & Parks LLP; Michael H. Minns

(57) ABSTRACT

A flow through railroad freight car may include a body having a containment structure. The body may be mounted upon railcar trucks for rolling motion along railroad car tracks. The containment structure may include one or more hoppers, each of which may have inflow and outflow ports, by which means lading may be introduced into the car, or discharged from it. The inflows may include an upper intake, which may be a series of hatches and hatch coamings. The hatch coamings may stand outwardly from the containment structure, and may also having internally extending skirts. In one instance, the skirts may be of a first length corresponding to a first fill level, or volume, for use with lading of a first density. The length of the skirt may be adjusted at a later time to correspond to a second fill level, or volume, for use with lading of a second density.

28 Claims, 8 Drawing Sheets

FLOW THROUGH RAIL ROAD FREIGHT CAR

FIELD OF THE INVENTION

Figure 1A:
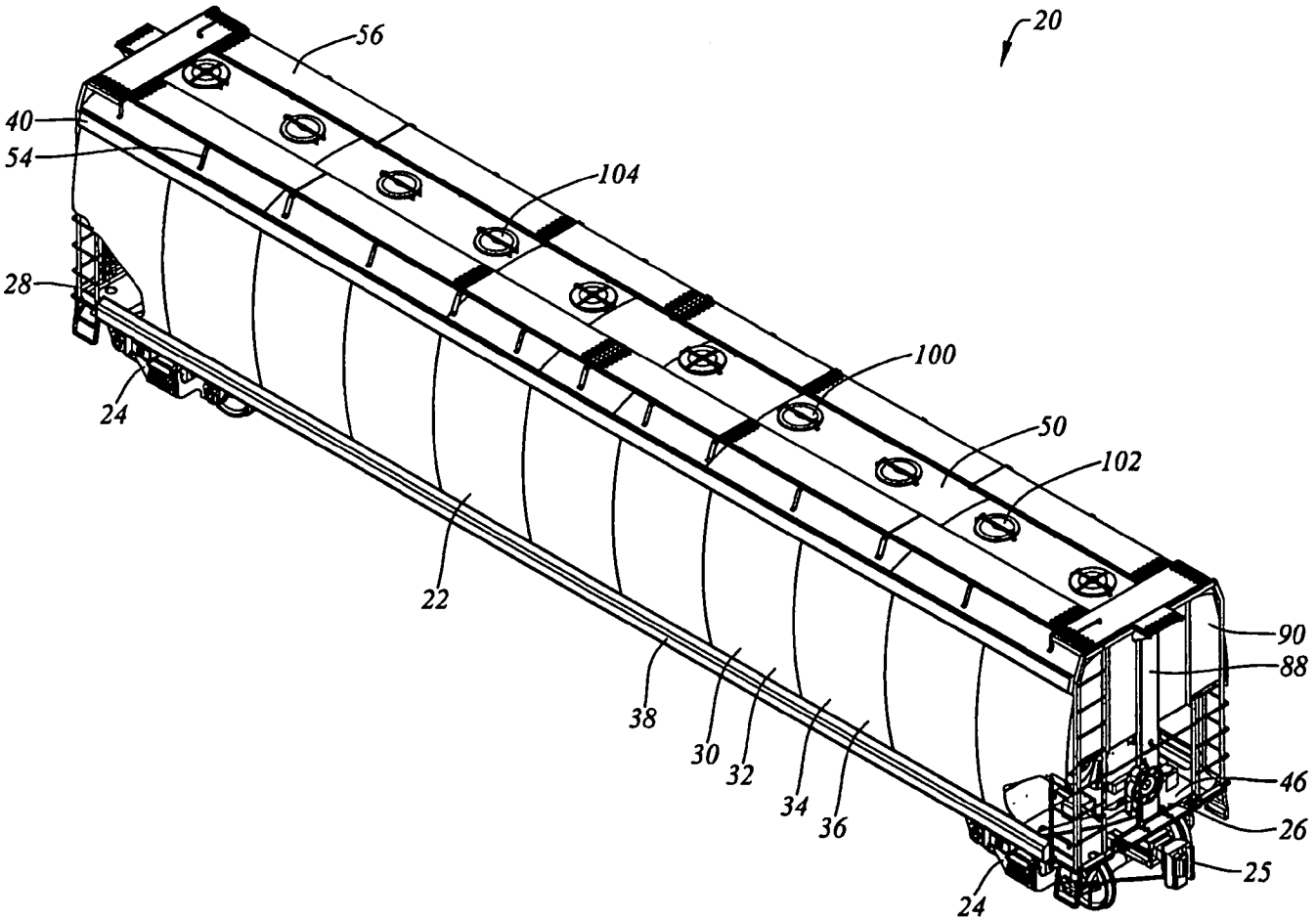

The present invention relates to the field of flow through rail road freight cars, such as center flow cars in the nature of hopper cars.

BACKGROUND OF THE INVENTION

Flow through rail road freight cars are typically used for carrying bulk commodities in the form of ore, aggregate, granules, grain, ash or pellets. The cars typically have a containment structure, which may be a hopper, or an array of hoppers, that includes one or more entrances or hatches or intakes at the top, and one or more exits, outlets, or gates at the bottom. The lading, of whatever type it may be, is of a kind that may tend to flow somewhat like a liquid under the urging of gravity. Perhaps the most common example of this type of car is a center flow car of three or four hoppers.

Generally speaking, it is desirable for a center flow car to have a large internal volume. It is also generally desirable for that internal volume to correspond to the amount of intended lading that will tend to match the permissible gross rail load for that rail road car. The volume required to achieve this will depend on the density of the lading. It may not be desirable to fill the full potential volume of the car with a higher density lading if to do so would cause the car to exceed its allowable gross rail load, be it "100 Tons" i.e., 263,000 lbs GRL, "110 Tons", i.e., 286,000 lbs GRL or "125 Tons" i.e., 315,000 lbs GRL.

SUMMARY OF THE INVENTION

In an aspect of the invention, there is a flow through railroad freight car having a containment shell carried by rail road car trucks for travel along railroad tracks. The containment shell defining an enclosed chamber and at least one outflow mounted to a lower region of the containment shell and at least one inflow mounted to an upper region of the containment shell. The inflow includes a coaming. The coaming standing proud of the containment shell a first distance. The coaming including a depending skirt. The depending skirt extending inwardly of the containment shell into the chamber a second distance and the second distance being at least one half as great as the first distance.

In a feature of that aspect of the invention, the skirt is of variable length. In a further feature, the skirt is at least partially removable. In a further feature, the second distance is at least half as long as the first distance. In a still further feature, the containment shell has a nominal capacity. The skirt has a lower margin, and when the railroad car is on flat track, a portion of the nominal capacity of the railroad car lies at a higher level than the lower margin of the skirt, and that portion of the nominal capacity is at least 2% of the nominal capacity. In another feature, that car portion of the nominal capacity is at least 5% thereof. In another feature it may be more than 10%, and may be as much as 20%.

In another feature, the containment shell has an internal coating, the coating being a protective epoxy coating. In an alternate embodiment, the containment shell may have a bare steel or aluminum surface. In a further feature, the containment shell has a nominal capacity in excess of 4500 cu. ft. In still another feature, the containment shell includes at least three sub-compartments, each of the sub compartments having a separate outflow. In a further feature, the flow through rail road car falls within AAR Plate F. In a further feature, the containment shell includes laterally outwardly bulging side sheets.

In another aspect of the invention, there is a flow through railroad car having side sills, top chords spaced upwardly from the side sills, and a containment shell that includes side sheets extending between the side sills and top chords. The side sheets have an uppermost margin. The car has a hatch coaming. The hatch coaming has an inwardly depending skirt. The skirt has a lowermost margin extending to a level lower than the uppermost margin of the side sheets.

In a further feature, the depending skirt is made of a substantially inert material. In a another feature, the flow through railroad car inert material is one of (a) stainless steel; and (b) a metal member having a protective epoxy surface coating.

In a another aspect of the invention, there is a flow through railroad car. It includes a railcar body having a pair of end sections, each end section being mounted over a rail car truck, and including a stub center sill. A pair of spaced apart side sills run between and a pair of spaced apart top chord members run between the end sections. Sidewalls extend upwardly between the side sills and the top chords. The sidewalls have an outwardly bulging curvature between the side sills and the top chords. End bulkheads extend between the sidewalls. There is a hopper array. It includes at least three sub-chambers, each sub-chamber having a pair of sloped side sheets and a pair of sloped end sheets. The slope side sheets and sloped end sheets co-operate to form a rectangular outflow. The outflow has a gate valve mounted thereacross, the sloped side sheets having upward margins meeting the sidewalls. Arcuately, formed roof sheets extend between the sidewalls over the hopper array. There is an array of inflow ports formed in the roof sheets. The inflow ports have upstanding coamings, and hatches mounted to the coamings. The hatches are operable to govern admission of lading into the hopper array. The hopper array, sloped sheets, sidewalls and roof sheets cooperatively define a containment shell having at least one enclosed chamber. The coamings have internally depending skirts. The skirts protrude inwardly of the roof sheets a distance greater than 3 inches. At least one of the skirts protrudes at least ½ as far into the enclosed chamber as its respective coaming stands upwardly of the roof sheets.

In another aspect of the invention, there is a process of adjusting the volumetric fill capacity of a flow through rail road car. The process includes the step of providing a flow through railroad freight car having a containment shell carried by rail road car trucks for travel along railroad tracks. The containment shell defines an enclosed chamber. It has at least one outflow mounted to a lower region of the containment shell as well as at least one inflow mounted to an upper region of the containment shell. The inflow includes a coaming and the coaming stands proud of the containment shell a first distance. The coaming includes a depending skirt and the depending skirt extends inwardly of the containment shell into the chamber a second distance. The process includes the step of changing the second distance by undertaking a step chosen from the set of steps consisting of (a) adding a further portion to the skirt, the further portion being of a length great enough that the second distance, as changed, exceeds one third of the first distance; (b) removing a portion from the skirt to reduce the second distance, the second distance having been greater than one third of the first distance before removing the portion; (c) removing the skirt and replacing the skirt with another skirt of different length; and (d) mounting another skirt co-axially with the depending skirt, the other skirt being positioned to have a lower margin protruding below the depending skirt.

In a further feature, the process includes adding a further portion to the skirt, and the step of adding includes welding the additional portion in place. In another feature, the process includes coating the skirt with a protective coating after changing the second distance. In another feature, the process includes the step of replacing a lining of the flow through rail road car contemporaneously with changing the distance. In another feature, the process includes the step of determining a volumetric full condition according to a designated lading density, providing a volumetric capacity schedule, and adjusting the skirt length according to the schedule to match the density.

In a further aspect of the invention, there is a flow through railroad freight car. It has a containment shell carried by rail road car trucks for travel along railroad tracks. The containment shell defines an enclosed chamber. The containment shell has a nominal volumetric capacity. At least one outflow is mounted to a lower region of the containment shell. At least one inflow mounted to an upper region of the containment shell. The inflow includes a coaming. The coaming has a depending skirt. The depending skirt extends inwardly of the containment shell into the chamber. The skirt has a lower margin. When the railroad car is on flat track, a portion of the nominal capacity of the railroad car lies at a higher level than the lower margin of the skirt, and the portion of the nominal capacity is at least 2% of the nominal capacity.

In a feature of that aspect, the portion of the nominal volumetric capacity lies in the range of 2 to 30% of the nominal volumetric capacity. In a narrower feature, the portion of the nominal volumetric capacity lies in the range of 10 to 20% of the nominal volumetric capacity.

In still another aspect of the invention, there is a flow through railroad freight car. It has a containment shell carried by rail road car trucks for travel along railroad tracks. The railroad car has a coupler centerline height. The containment shell defines an enclosed chamber. At least one outflow is mounted to a lower region of the containment shell. At least one inflow is mounted to an upper region of the containment shell. The shell includes a roof panel having a roof panel profile having an apex. The inflow includes a coaming. The coaming has a depending skirt. The depending skirt extends inwardly of the containment shell into the chamber. The skirt has a lower margin defining an inflow height limit. A first vertical distance is defined between the coupler centerline height and the apex. A second distance is defined between the inflow height limit of the lower margin of the skirt and the apex. The second distance is in the range of 3% to 25% of the first distance.

In a feature of that aspect of the invention, the second distance is in the range of 5-20% of the fist distance. In a narrower feature, the second distance is about 10-15% of the fist distance.

BRIEF DESCRIPTION OF THE ILLUSTRATIONS

Figure 1C:
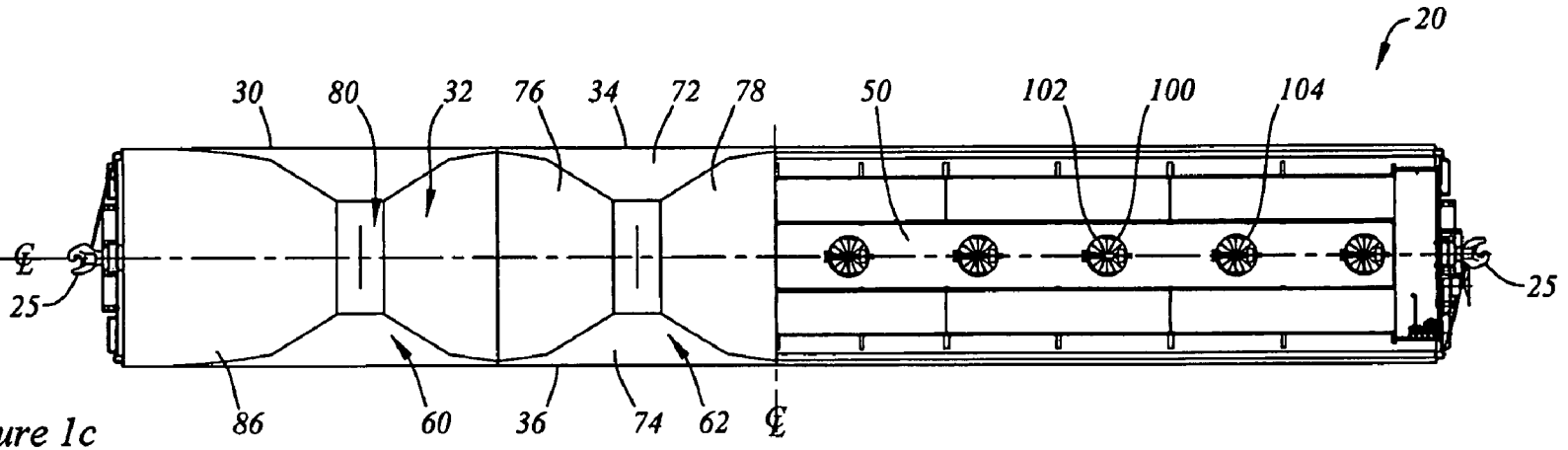
Figure 1B:
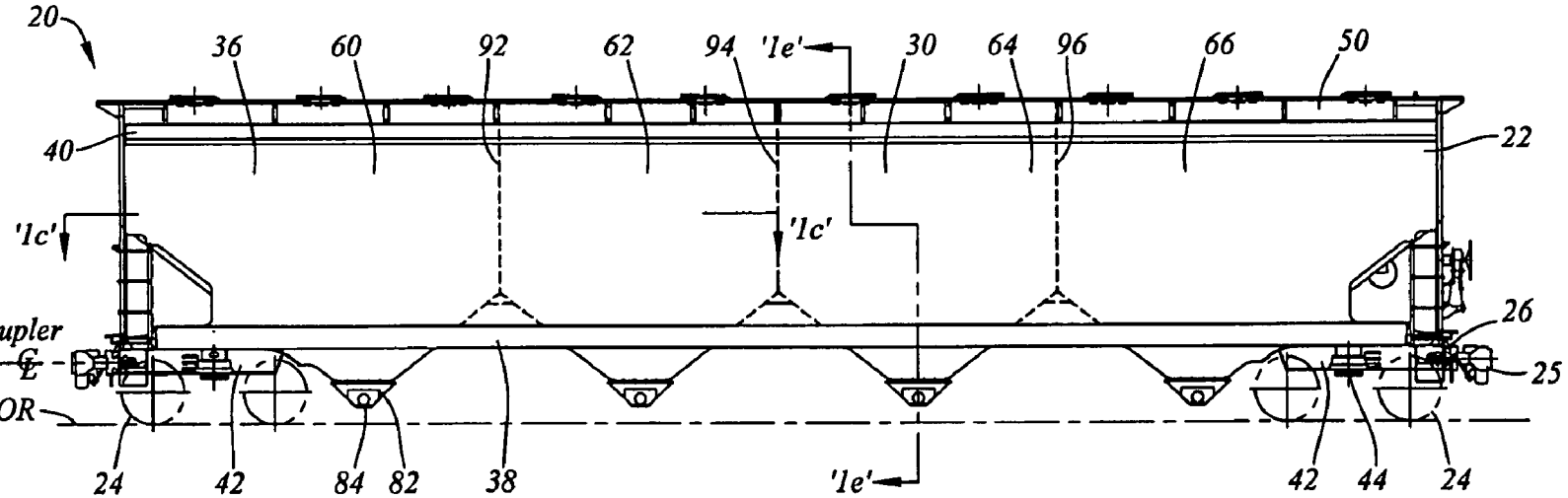

These and other aspects and features of the invention may be understood by reference to the detailed description which follows, and the accompanying illustrative Figures, in which:

FIG. 1*a* is an isometric view of a center flow railroad car;

FIG. 1*b* is a side view of the center flow railroad of FIG. 1*a;*

FIG. 1*c* is a top view of the center flow rail road car of FIG. 1*a*, one half of the car being shown as viewed on section '1*c*-1*c*' in FIG. 1*b;*

Figure 1D:
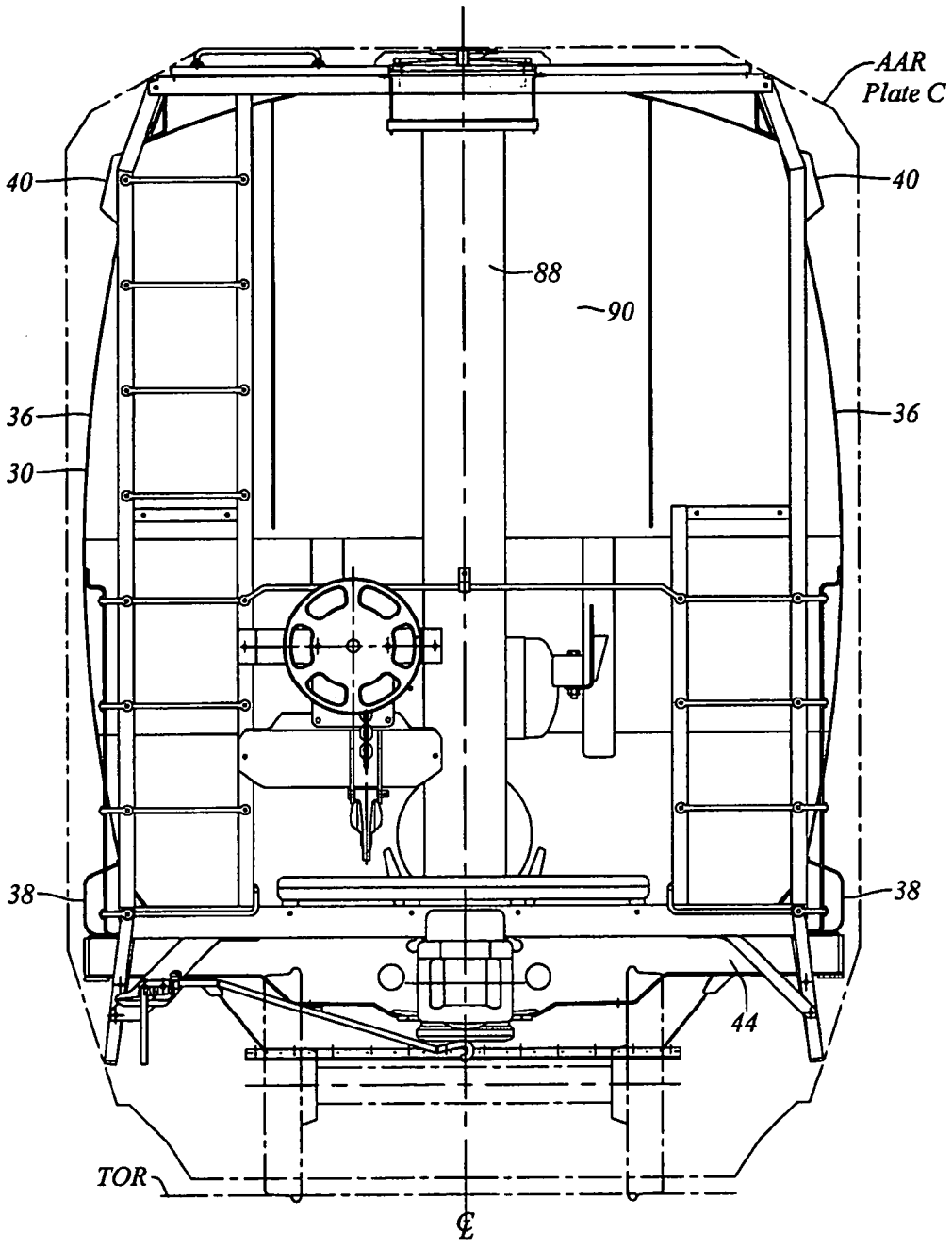

FIG. 1*d* is an end view of the rail road car of FIG. 1*a;*

Figure 1E:
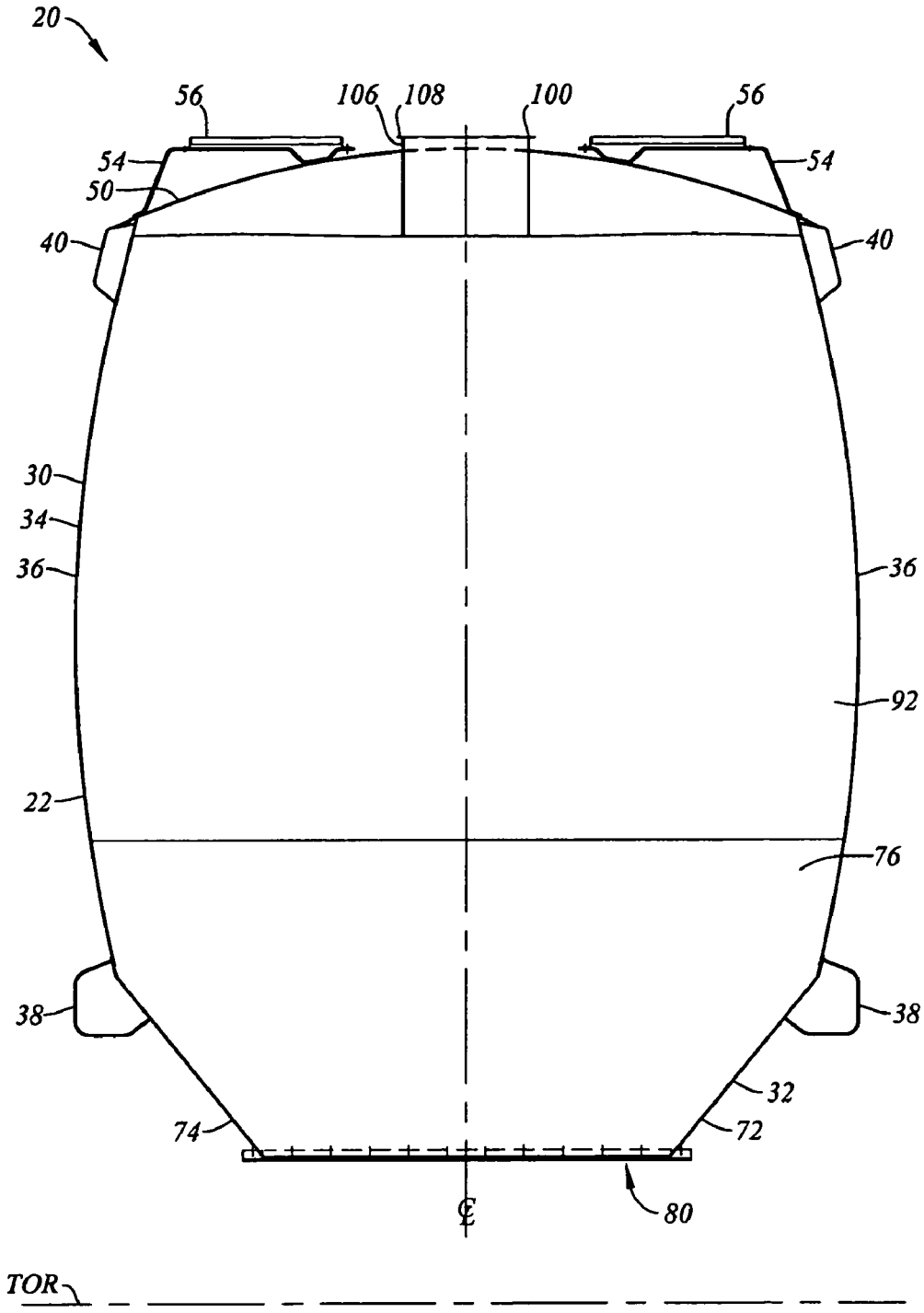
Figure 2A:
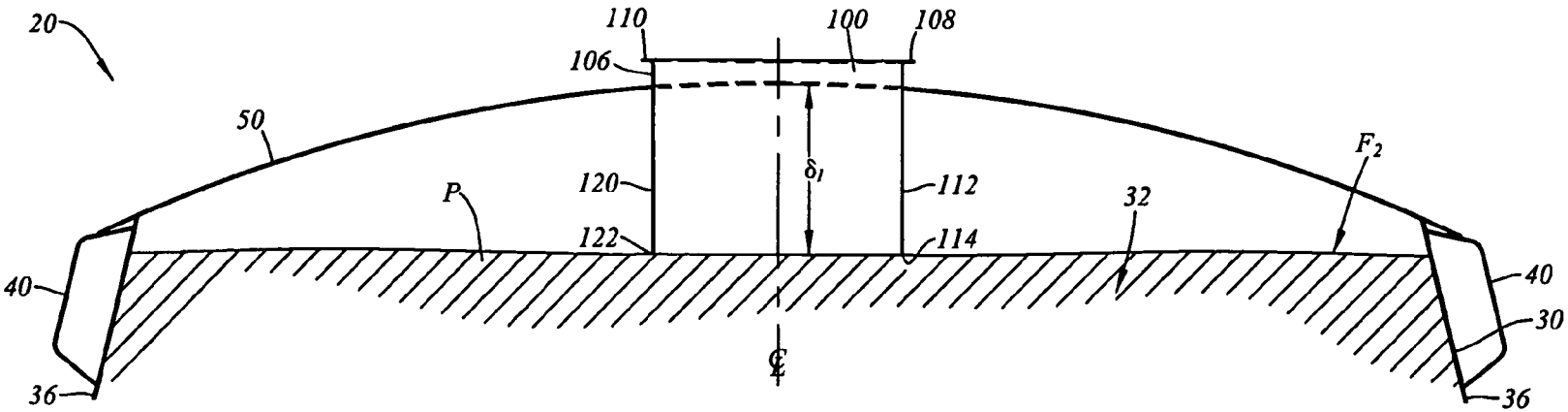

FIG. 1*e* is a cross-sectional view on '1*e*-1*e*' of the center flow rail road car of FIG. 1*b* in a lower capacity configuration;

FIG. 2*a* is a sectional detail of a lower capacity inlet of the rail road car of FIG. 1*e;*

Figure 2B:
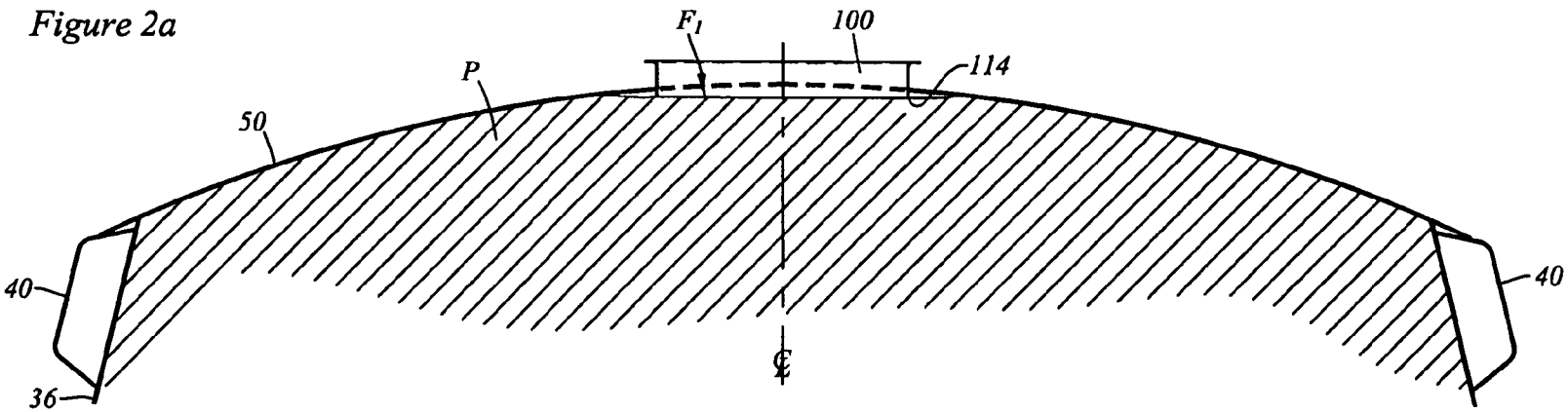

FIG. 2*b* is a sectional detail of a higher capacity inlet configuration analogous to FIG. 2*a* of the rail road car of FIG. 1*b;*

Figure 3B:
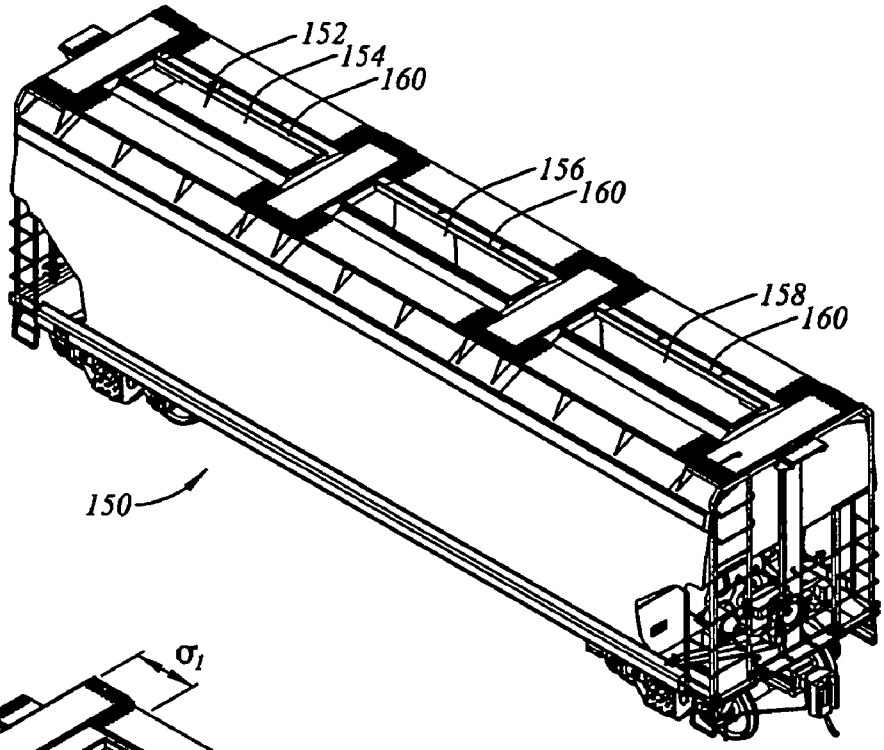
Figure 3A:
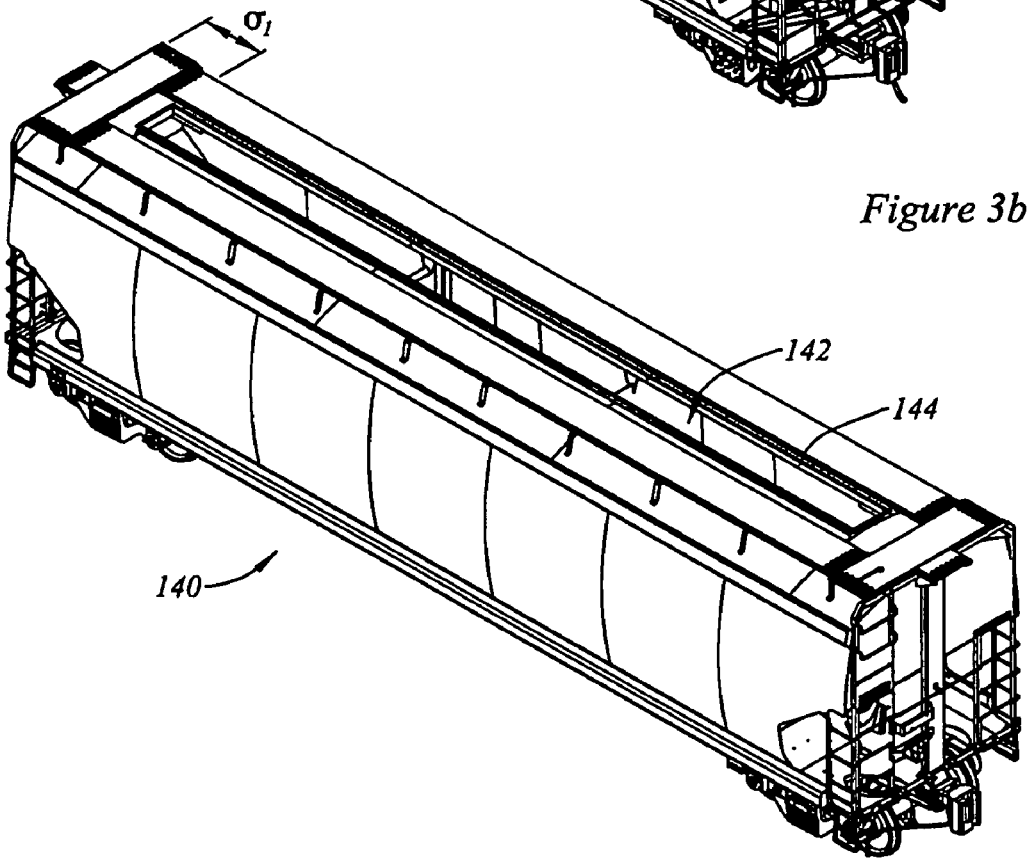
Figures 4A, 4B:
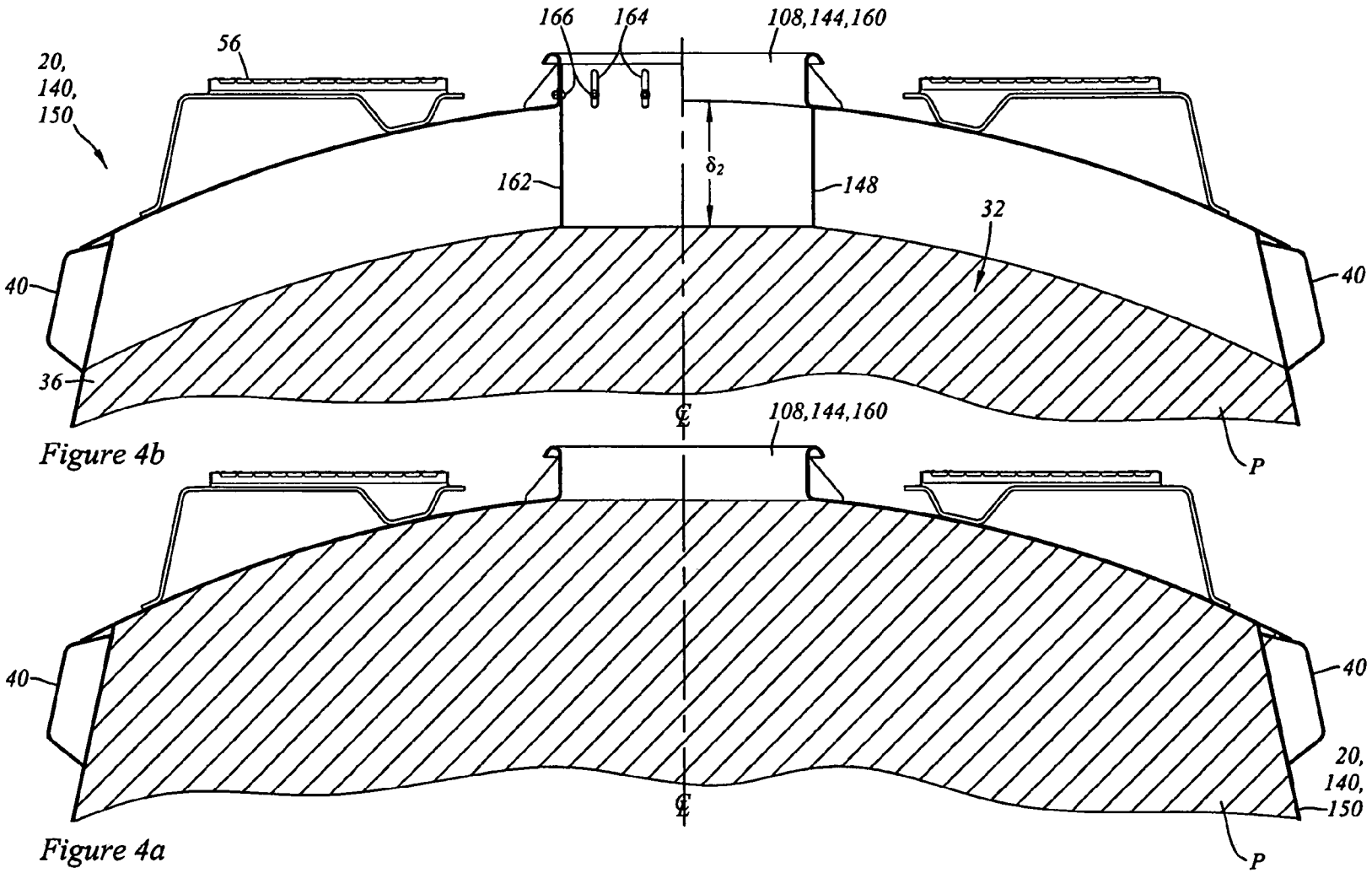
Figure 4C:
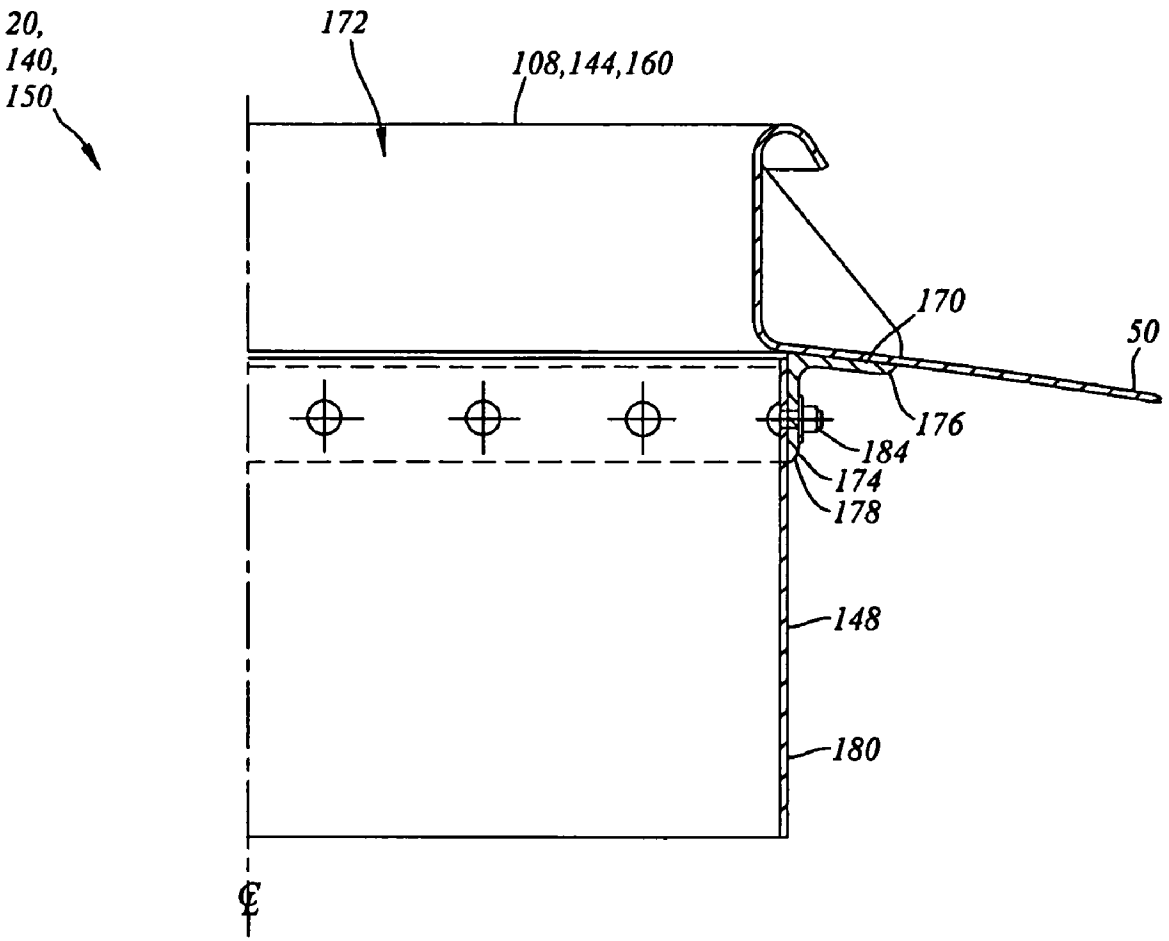

FIG. 3*a* is an isometric view of a grain car;

FIG. 3*b* is an isometric view of a potash car;

FIG. 4*a* is a cross-sectional detail view of either the grain car of FIG. 3*a* or the potash car of FIG. 3*b* in a first configuration;

FIG. 4*b* is a cross-sectional detail view of the car of FIG. 4*a* in another configuration; and FIG. 4*c* is a cross-sectional detail view of the car of FIG. 4*a* in a further configuration.

DETAILED DESCRIPTION

The description that follows, and the embodiments described therein, are provided by way of illustration of an example, or examples, of particular embodiments of the principles, aspects and features of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention. Unless stated otherwise, the terminology used in this specification is to be interpreted in accordance with, and to be given the usual, ordinary, and customary meanings of, terms as they are understood by persons of ordinary skill in the art in the North American railroad industry. Unless stated otherwise, or used otherwise herein, the meanings of terminology used herein explicitly exclude strained, obscure, or unreasonably broad readings, including such meanings as may be found, for example, in references taken from outside, or originating outside, the North American railroad industry.

In terms of general orientation and directional nomenclature, for each of the rail road cars described herein, the longitudinal direction is defined as being coincident with the rolling direction of the rail road car, or rail road car unit, when located on tangent (that is, straight) track. In the case of a rail road car having a center sill whether straight through, or a stub center sill, the longitudinal direction is parallel to the center sill, and parallel to the side sills, if any. Unless otherwise noted, vertical, or upward and downward, are terms that use top of rail, TOR, as a datum. The term lateral, or laterally outboard, refers to a distance or orientation relative to the longitudinal centerline of the railroad car, or car unit. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis.

FIG. 1*a* shows a flow through railroad car, generally indicated as 20. Flow through rail road car 20 may be a center flow hopper car. Rail road car 20 may have a car body 22 mounted upon rail road car trucks 24 for rolling motion along rail road tracks. Typically, a car unit may have trucks at either end, and may be in the form of a single car having releasable knuckle couplers 25 at either end, or may be a multi-unit car having several units connected by internal drawbars. Rail Road Car 20 may conform to the construction standards of the Association of American Railroads (AAR), and in particular to AAR Standard M-1001, and may be of a size falling within AAR Plate F. Alternatively, car 20 may be built to conform to AAR Plate C. Whether Plate C or Plate F, there may be an adjustment for length for swing out as may be required where the truck centers exceed 46'-3". Where standards are referred to herein, those standards are to be interpreted as of the date of filing of this application, or, where the application claims priority from an earlier case, then as of the date of first filing of the earliest application from which priority is claimed.

Car body 22 may include first and second end sections 26, 28, each of which seats over one of trucks 24. Car body 22 may also include a hollow containment structure 30, having a catchment space, bin, receptacle, or array of receptacles 32, for accommodating lading. Containment structure 30 may include an upstanding wall structure 34 that may extend longitudinally over substantially the entire length of car 20, and that may have wall side sheets 36 extending upwardly between a pair of side sills 38, and top chord members 40. Side sheets 36 may have an outwardly bulging curvaceous form. Side sills 38 may run along, and may be connected to, the outboard margins of the end sections 26, 28. End sections 26, 28 may also include longitudinally oriented stub sills 42, a cross-wise mounted main bolster 44, and substantially planar horizontal shear plates 46 that carry loads between the stub sills and the side sills. Containment structure 30 may also include roof panels 50 such as may extend between, and be structurally connected to, the upper margins of side sheets 36. Top chord members 40 are mounted adjacent to this junction, and may tend to reinforce it. In one embodiment, top chord members 40 lie immediately outboard of this junction, and the run-off end or edge of the roof panel is welded to the uppermost leg of the roll formed top chord member. Roof panels 50 may be surmounted by an array of spaced apart car lines 54 and cat-walks 56.

The lower regions of containment structure 30 may include one or more substantially pyramidal hoppers 60, 62, 64, 66. There may be more, or fewer hoppers. For example, a cement car may have two such hoppers; a grain or pellet car may typically have 3 or 4 such hoppers in an array, or more. Each hopper may include left and right hand sloping side sheets 72, 74, and fore-and-aft sloping end sheets, 76, 78. Those sloping side sheets and sloping end sheets may be formed into an inverted rectagonal pyramid. The tip of the pyramid may be truncated to define a rectangular opening 80, and a closure assembly 82, such as a gate valve 84 may be mounted about the lower margin of the respective hopper. Each gate valve 84 is movable between a full open and a fully closed position to govern outflow of lading from each respective hopper. It may be noted that the end slope sheets 86 of the end hoppers, 60 and 66 are larger than the internal slope sheets, and terminate at end bulkheads 90 that conform to the shape of the upper regions of the side sheets and roof panels, and that define the ends of containment structure 30. A vertical stem post 88 may run upwardly from the outboard end of the stub sill to reinforce end bulkheads 90. Containment structure 30 may also include intermediate internal bulkheads 92, 94, 96 that extend upwardly from the intersection of the end slope sheets of the adjoining hoppers, and that have profiles conforming to the interior of side sheets 36.

The upper region of containment structure 30, such as roof panels 50, may include porting 100, such as may include at least one inlet or hatch 102. Roof panels 50 may tend to extend arcuately upwardly and inwardly from top chord members 40, and may have a crest or apex along the longitudinal central place of car 20. There may be an array of hatches 102, which may include one, two, three or more hatches per hopper. Each hatch may include a hatch cover 104, such as may be movable between an open position and a closed position to govern the admission of lading into the respective hopper of that particular hatch (it being assumed, generally, that the corresponding gate valve is closed when lading is introduced at hatch 104). Each hatch 104 may include an upstanding wall structure, in the nature of a surround, 106, that may be referred to as a coaming 108. The coaming may include an outwardly rolled surmounting rim 110 to which hatch cover 104 may be opposed in a sealing relationship when hatch cover 104 is in the closed position. Coaming 108 may also include a depending skirt portion 112, that may extend inwardly of the profile of roof panels 50 into receptacle 32. It may be that coaming 108 is made of a non-contaminating material, or may be coated with a non-contaminated coating of a type suitable for the type of lading with which car 20 is to be laded. Similarly, the interior of containment structure 30 may be provided with a non-contaminating surface, whether by means of a surface treatment of the underlying material, or by means of the application of a surface coating or liner. For example, a paint or epoxy coating may be applied to the internal surface of containment structure 30, such as may be suitable for the lading. Similarly, coaming 108 may be made of a material such as stainless steel, such as may tend not to react with various types of lading P, such as plastic feedstock pellets.

It may be that containment structure 30 has a nominal internal volume when filled substantially completely to the roof-line, as indicated in FIG. 2*b*. In such circumstances, the downwardly protruding lip 114 of coaming 108 may protrude only marginally below the roof line, perhaps a distance on the order of an inch. There are two predominant filling methods for these cars, one employing a centripetal casting, or spreading head, and the other employing a pipe or hose through which the feedstock is caused to flow. Both loading systems are responsive to back pressure, and, when the lower lip of the skirt is reached, loading stops. Alternatively, in a third loading method, such as may be used in grain cars, the lading is fed by gravity, and will fill the coaming to overflow, but the volume may be reduced since the lading may tend to lie on the slope of the angle of repose of the material from the bottom lip of the skirt to the wall of the containment structure. Thus the lower the lip, the less lading may tend to be carried.

It may be that a car owner may wish to prevent more than a certain portion of car 20 from being filled. In that instance, coaming 108 may include an abnormally extended skirt, as shown at 120 in FIG. 2*a*. In this instance, filling may tend to cease at a level corresponding to the level of lower lip 122, leaving that portion of receptacle 30 lying above that level unfilled. Thus, the "full" level $F_2$ may tend to occur at a volume that is some lesser percentage of the nominal full level $F_1$.

In some embodiments, the nominal volumetric capacity of the containment shell may be greater than 4500 cu. ft. In one embodiment, the nominal volume of all of the enclosed spaces of car 20 may be more than 5500 cu. ft., and may be about 6245 cu. ft. In one embodiment, skirt 120 may protrude into receptacle 30 a distance of greater than 2 inches. That distance identified as $\delta_1$ in FIG. 2*a*, may lie in the range of 4 to 24 inches, and in one embodiment may be as much as 30 or 36 inches. In one embodiment it may lie in the range of 8 to 18 inches, and in another embodiment, 12 to 15 inches, and in another it may be about 13½ inches. This height may be expressed differently, as a proportion, for example, of the height from the coupler centerline height (34½ inches above top of rail) to the height of the apex of the contour of the roof panels along the central longitudinal vertical plane of the car. In one embodiment, this ratio may be in the range of 2 and 20%. In another embodiment, this ratio may be between 3 and 15%. In another embodiment, it may be in the range of about 5 to 10%. In another embodiment, it may be between 2% and as much as 25%.

It may be that the fill volume may be associated with the skirt length according to a set formula or schedule. The schedule may be provided in a tabular form in which one column indicates heights from a datum in one inch, or half inch increments, and a second column may indicate the internal volume associated with each of the respective heights. Alternatively, the schedule may be expressed in terms of an algebraic formula. Such as formula may have the form of a polynomial, and may have the form of a polynomial function with a step discontinuity. For example, where a parabolic function provides a sufficiently close first order approximation, $V_z=a_1(z)^{3/2}$ for $0<z<L_1$; and $V_z=a_1(L_1)^2+a_2(z-L_1)+a_3(z-L_1)^2$ for $L_1<z<N$, where $V_z$ is the volume of the fraction of the nominal volume lying above lip 122, and the volume then available for filling is the nominal volume of the containment shell, $V_0$, less $V_z$. $L_1$ is the vertical distance to the intersection of the roof panels and the side sheets, at which the volume function may have a discontinuity. Co-efficients $a_1$, $a_2$, and $a_3$ depend on the specific geometry of the structure. In one embodiment, $V_0$ may be about 6245 cu. ft., $L_1$ may be about 11¼ inches; the value $a_1(L_1)^2$ may be about 317 cu. ft.; the value $a_2L_1$ may be about 127 cu. ft.; and the value $a_3(L_1)^2$ may be about 0.32 cu. ft. N may be perhaps as much as 40 inches. Other functions may be used to establish a volume schedule. In one embodiment the proportion of volume above lip 122 may be in the range of 2 to 20 (or perhaps as much as 25) percent of the nominal volume. In another embodiment, it may be in the range of 4 to 10% of the nominal volume. In another it may be about 7½%.

The car operator may wish to change the length of skirt 120 to correspond to a different type of lading having a different density, and hence a different "full" height at the gross rail load limit. In the instance in which the density of the material to be transported is less than the density of material for which the car had previously been in service, the operator may apply the formula, or consult the schedule to determine the corresponding skirt length, and the skirts may be marked and trimmed accordingly. A surface coating may be applied to the trimmed skirts, as may be appropriate. Inasmuch as car linings may tend to require periodic replacement or refurbishment, it may be that the volumetric change may occur at a time when the liner is also being renovated. In the instance in which the density of the material to be transported is greater than previously, then a skirt of greater length may be required. To that end, a collar may be added to the depending end of skirt 120 according to the same formula or schedule as considered before. It may be that such an additional collar may be a stainless steel collar that is welded in place, and cleanly ground. Alternatively, the old skirt, or the coaming in its entirety, may be removed and a new skirt (and coaming, as may be), of different length, may be installed in place of the original skirt (and coaming, as may be). In the further alternative, an auxiliary skirt member, or cuff, may be nested inside the existing skirt, or outside the existing skirt, and fixed in place, e.g., by bonding, welding or mechanical fastening, with the new auxiliary skirt having a lower margin extending to a different height than was formerly the case, such as to a lower height than formerly. As before, a coating may be applied. Such coating may be a protective epoxy coating. Skirt length adjustment may occur at the time of renovating the interior lining or coating of the receptacle, or receptacles, as may be. It may be that the adjustment of volumetric capacity may occur only infrequently, such as after several years of service.

It may be that a volume restricting skirt may be desired in a rail road car of a type not having round hatches. For example, as shown in FIG. 3*a*, an agricultural products car, such as a grain car 140, may have an inlet array in the nature of a single longitudinally running trough 142 that runs, in one embodiment, more than half the length of the car, and that may run substantially the entire length of the car, less a bit at the ends, such that the entire car may be filled from this unitary trough. The trough may end a relatively small distance $\sigma_1$ from the end of the car, and may have a peripheral coaming 144, having a generally rectangular footprint, as indicated.

Alternatively, as shown in FIG. 3*b*, a bulk minerals car, such as a potash car 150 may have an inlet array in the nature of a set of troughs 152, which may include individual trough members 154, 156, 158, which may have rectangular or oval shapes. It is intended that array 152 be generically representative of any plural number of troughs, be it 2, 3, 4 or some other number. In each case, the trough member may include a peripheral coaming 160.

FIG. 4*a* shows a car, be it 20, 140, or 150, without an internally protruding skirt. FIG. 4*b* shows the same car in a configuration in which a skirt is installed. In some embodiments, which may be embodiments that are grain or potash cars, the coaming may be formed as an integral part of the roof panel. In those embodiments, rather than meeting at a welded corner, the coaming and the main portion of the roof panel may meet along a radiused bend, which may be formed as a pressing. Whether in the case of a car having round, rectangular or oval inlet openings, and whether having hatch covers or not, a welded skirt 148, substantially as described above, may be used, as shown in the right hand portion of FIG. 4*b*. Alternatively, a skirt, or array of skirt members, such as may be symbolized by skirt member 162, may include adjustment slots 164 to permit variation in the dependency distance $\delta_2$. Skirt 162 may be help in place by mechanical fasteners 166 which may be releasable threaded fasteners, or which may be plastically deforming mechanical fasteners such as rivets or Huck™ bolts. The bolt shaft may protrude outwardly through co-operating apertures in the coaming wall, with the nut, clinching member or collar on the outside, and a relatively smooth head, like a pan head or carriage bolt head, on the inside. The apertures in the coaming may also be slots, or, alternatively, the apertures in the coaming may be slots, while the apertures in the skirt may be bores of a size to fit the mechanical fasteners. In either case the fittings of the coaming and the skirt are co-operable to permit the position of the bottom lip of the coaming, and hence the protrusion depth, to be adjusted. It may be that a relatively difficult-to-adjust fastener, such as one requiring a non-standard tool, or one requiring the destruction of the fastener to permit re-adjustment such as a rivet or bolt relying on a plastic deformation clinching device, may be advantageous for deterring unintended adjustment. Skirt 162 may be made of a plastic, stainless steel, or other suitable material such as may be appropriate for the nature of the lading to be carried. Skirt 162 may have a surface coating.

In a further alternate embodiment, such as shown in FIG. 4*c*, an internal surround, or bezel, or frame is formed by mounting skirt hangars 170 about the inlet opening, or openings identified as 172. Skirt hangars 170 may be in the form of angle iron, indicated as 174, in which the heel of the angle iron is mounted adjacent to the opening. One toe 176 may point generally away from the opening and lies against the roof sheet 50, while the other toe depends substantially vertically. The depending toe, 178, may have bores formed thereon. Skirt members 180 may be attached by means of fasteners 182, such as threaded fasteners or plastically deforming Easterners, as discussed above. Where threaded fasteners are employed, the receiving collar or nut 184 may be pre-welded to depending toe 178. The railcar of the embodiment of FIG. 4*c* may be a grain car or a potash car.

In alternate embodiments, the car body containment shell may be made out of other materials such as aluminum, steel, or stainless steel, depending on the intended lading. The inwardly extending skirt depending from the coaming may similarly by made of steel, stainless steel, aluminum, or plastic, or a composite such as a plastic resin with fibrous reinforcement. Coatings may or may not be applied, depending on the nature of the lading. For example, a grain car may not necessarily include a coating, whereas a pellet car for carrying plastic feedstock may have an epoxy coating, and a car for carrying sodium chlorate may be made of aluminum, with an uncoated surface.

Although the cars may have curved sides, they may also have straight sides, which may extending in vertical planes. In alternate embodiments, too, the intake may be in the form of an extended trough or troughs or circular hatchways. There may be, for example, 2 or three oval troughs of 10 to 12 feet in length, of a substantially continuous trough running the majority of the length of the car from end to end.

In some embodiments, it may be that a nested collar arrangement may be unacceptable due to the possibility of contamination of the lading be previous lading that may have migrated into cracks or crevices between the nested collars. In such embodiments, the process of renovation may include the step of fully sealing any seams between the nested members, as in a double lap joint, such as may be made by welding. Alternatively, the process may include forming a collar of the same diameter as the existing skirt, and forming a continuous peripheral join, such as a peripheral butt weld, which may subsequently be ground to a flush condition.

Various embodiments of the invention have been described in detail. Since changes in and or additions to the above-described embodiments may be made without departing from the nature, spirit or scope of the invention, the invention is not to be limited to those details but only by the appended claims.

We claim:

1. A flow through railroad freight car comprising:

a containment shell carried by railroad car trucks for travel along railroad tracks;

said containment shell defining an enclosed chamber;

at least one outflow mounted to a lower region of said containment shell;

at least one inflow mounted to an upper region of said containment shell;

said inflow including a coaming;

said coaming standing proud of said containment shell a first distance;

said coaming including a depending skirt terminating at a lip;

said depending skirt extending inwardly of said containment shell into said chamber a second distance to said lip;

said skirt permitting lading introduced through said inflow to flow therepast into said containment shell;

said skirt inhibiting filling of said containment shell upwardly of said lip; and said second distance being at least one half as great as said first distance; and said skirt is at least one of (a) of variable length; and (b) removable.

2. The flow through railroad freight car of claim 1 wherein said second distance is at least three quarters as long as said first distance.

3. The flow through railroad freight car of claim 1 wherein said containment shell has a volumetric capacity, said skirt has a lower margin, and when said railroad freight car is on flat track, a portion of said volumetric capacity of said railroad freight car lies at a higher level than said lower margin of said skirt, and said portion of said volumetric capacity is at least 2% of said volumetric capacity.

4. The flow through railroad freight car of claim 3 wherein said portion of said volumetric capacity is at least 5% thereof.

5. The flow through railroad freight car of claim 1 wherein said containment shell has an internal coating, said coating being a protective coating.

6. The flow through rail road freight car of claim 1 wherein said containment shell has a volumetric capacity in excess of 4500 cu. ft.

7. The flow through railroad freight car of claim 1 wherein said containment shell includes at least two sub-compartments, each of said sub-compartments having a separate outflow.

8. The flow through railroad freight car of claim 1 wherein said containment shell falls within AAR Plate C.

9. The flow through railroad freight car of claim 1 wherein said containment shell includes laterally outwardly bulging side sheets.

10. The flow through railroad freight car of claim 1 wherein said depending skirt includes an array of slots to permit adjustment of said skirt.

11. A flow through railroad freight car comprising:

a containment shell carried by railroad car trucks for travel along railroad tracks;

said containment shell defining an enclosed chamber;

at least one outflow mounted to a lower region of said containment shell;

at least one inflow mounted to an upper region of said containment shell;

said inflow including a coaming;

said coaming standing proud of said containment shell a first distance;

said coaming including a depending skirt terminating at a lip;

said depending skirt extending inwardly of said containment shell into said chamber a second distance to said lip;

said skirt permitting lading introduced through said inflow to flow therepast into said containment shell said skirt inhibiting filling of said containment shell upwardly thereof about said skirt;

and said second distance being at least one half as great as said first distance;

side sills, and top chords spaced upwardly from said side sills;

said containment shell includes side sheets extending between said side sills and top chords, said side sheets having an uppermost margin; and said skirt has a lowermost margin extending to a level lower than said uppermost margin of said side sheets.

12. The flow through railroad freight car of claim 11 wherein said skirt is of variable length.

13. The flow through railroad freight car of claim 11 wherein said skirt is removable.

14. The flow through railroad freight car of claim 11 wherein said depending skirt is made of a substantially inert material.

15. The flow through railroad freight car of claim 14 wherein said inert material is one of (a) stainless steel; (b) aluminum; (c) a plastic; and (d) a metal member having a protective surface coating.

16. A flow through railroad car comprising:

a railcar body having a pair of end sections, each end section being mounted over a railcar truck;

a pair of spaced apart side sills, said side sills running between said end sections;

a pair of spaced apart top chord members;

sidewalls extending upwardly between said side sills and said top chords, said sidewalls having an outwardly bulging curvature between said side sills and said top chords;

said sidewalls including side sheets, said side sheets having an uppermost margin;

end bulkheads extending between said sidewalls;

a hopper array including at least two sub-chambers, each sub-chamber having a pair of sloped side sheets and a pair of sloped end sheets, said sloped side sheets and sloped end sheets co-operating to form a rectangular outflow, said outflow having a gate valve mounted thereacross, said sloped side sheets having upward margins meeting said sidewalls;

arcuately formed roof sheets extending between said sidewalls over said hopper array;

an array of inflow ports formed in said roof sheets, said inflow ports having upstanding coamings, and hatches mounted to said coamings, said hatches being operable to allow admission of lading into said hopper array;

said hopper array, sloped sheets, sidewalls and roof sheets cooperatively defining a containment shell having at least one enclosed chamber;

said coamings having internally depending skirts intruding into said containment shell, each skirt terminating at a lip; and said skirts protruding inwardly of said roof sheets a distance greater than 3 inches to said respective lips, said containment shell having a volume, a portion of that volume being located upwardly of said lip, said skirts inhibiting filling of that portion of the volume upwardly of said lip; and at least one of said skirts protruding at least ⅓ as far into said enclosed chamber as its respective coaming stands upwardly of said roof sheets and said at least one of said skirts having a lower margin terminating at said lip that is lower than said uppermost margin of said side sheets.

17. A process of adjusting the volumetric fill capacity of a flow through rail road car, said process comprising the steps of:

providing a flow through railroad freight car having:

a containment shell carried by railroad car trucks for travel along railroad tracks;

said containment shell defining an enclosed chamber;

at least one outflow mounted to a lower region of said containment shell;

at least one inflow mounted to an upper region of said containment shell;

said inflow including a coaming;

said coaming standing proud of said containment shell a first distance;

said coaming including a depending skirt, said depending skirt terminating at a lip;

said depending skirt extending inwardly of said containment shell into said chamber a second distance to said lip; and changing said second distance by undertaking a step chosen from the set of steps consisting of:

(a) adding a further portion to said skirt, said further portion being of a length great enough that said second distance, as changed, exceeds one third of said first distance;

(b) removing a portion from said skirt to reduce said second distance, said second distance having been greater than one third of said first distance before removing said portion;

(c) removing said skirt and replacing said skirt with another skirt of different length; and (d) mounting another skirt co-axially with said depending skirt, said other skirt being positioned to have a lower margin protruding below said depending skirt.

18. The process of claim 17 wherein said process includes adding a further portion to said skirt, and said step of adding includes welding said additional portion in place.

19. The process of claim 17 wherein said process includes coating said skirt with a protective coating after changing said second distance.

20. The process of claim 17 wherein said process includes the step of replacing a lining of said flow through railroad freight car contemporaneously with changing said distance.

21. The process of claim 17 wherein said process includes the step of determining a volumetric full condition according to a designated lading density, providing a volumetric capacity schedule, and adjusting said skirt length according to said schedule to match said density.

22. The process of claim 17 wherein said skirt and said coaming have co-operating fittings, said fittings including slots, and said skirt being movable, and said process includes the step of adjusting the positioning of the co-operating fittings to adjust said second distance.

23. A flow through railroad freight car comprising:

a containment shell carried by railroad car trucks for travel along railroad tracks;

said containment shell defining an enclosed chamber, said containment shell having a volumetric capacity;

at least one outflow mounted to a lower region of said containment shell;

at least one inflow mounted to an upper region of said containment shell;

said inflow including a coaming;

said coaming including a depending skirt;

said depending skirt extending inwardly of said containment shell into said chamber;

said skirt has a lower margin terminating at a lip lying inwardly of said container shell, and when said railroad freight car is on flat track, a portion of said volumetric capacity of said railroad car lies at a higher level than said lip of said lower margin of said skiff, said lip inhibiting filling of said portion of said volumetric capacity, and said portion of said volumetric capacity is at least 2% of said volumetric capacity.

24. The flow through railroad freight car of claim 23 wherein said portion of said volumetric capacity lies in the range of 2 to 30% of said volumetric capacity.

25. The flow through railroad freight car of claim 23 wherein said portion of said volumetric capacity lies in the range of 10 to 20% of said volumetric capacity.

26. A flow through railroad freight car comprising:

a containment shell carried by railroad car trucks for travel along railroad tracks;

said railroad freight car having a coupler centerline height;

said containment shell defining an enclosed chamber, said containment shell having a volumetric capacity;

at least one outflow mounted to a lower region of said containment shell;

at least one inflow mounted to an upper region of said containment shell;

said shell including a roof panel having a roof panel profile having an apex;

said inflow including a coaming;

said coaming including a depending skirt terminating at a lip, said skirt inhibiting filling of said containment shell thereabout upwardly of said lip;

said depending skirt extending inwardly of said containment shell into said chamber;

said skirt has a lower margin at said lip defining an inflow height limit; a first vertical distance is defined between said coupler centerline height and said apex;

a second distance is defined between said inflow height limit of said lip of said lower margin of said skirt and said apex; and said second distance is in the range of 5-20% of said first distance.

27. The flow through railroad freight car of claim 26 wherein said second distance is about 10-15% of said first distance.

28. The flow through railroad freight car of claim 26 wherein:

said railroad car includes first and second side sills, first and second top chords and first and second arcuately outwardly bulging side sheets extending between said side sills and top chords respectively, said side sheets having an upper marginal edge;

said roof panel includes an arcuately concave roof sheet; and said skirt has a lower margin terminating at a level lower than said upper marginal edge.

* * * * *